US006012786A

United States Patent [19]

Dunn

[11] Patent Number: 6,012,786

[45] Date of Patent: Jan. 11, 2000

[54] CONSTRUCTION SITE DISPLAY AND STORAGE CASE

[76] Inventor: Gary D. Dunn, 2368 Podocarpus Way, Clearwater, Fla. 34619

[21] Appl. No.: 09/123,999

[22] Filed: Jul. 29, 1998

[51] Int. Cl.[7] ..... A47F 3/00

[52] U.S. Cl. ..... 312/100; 312/230; 312/351.1; 40/312; 40/607; 206/214; 206/232

[58] Field of Search ..... 312/100, 230, 312/351.1, 234; 40/312, 779, 607; 206/214, 232

[56] References Cited

U.S. PATENT DOCUMENTS

| | | | |
|---|---|---|---|
| 749,154 | 1/1904 | Benton . | |
| 843,719 | 2/1907 | Umberger | 312/230 X |
| 1,370,635 | 3/1921 | Draper | 40/647 |
| 1,453,658 | 5/1923 | Clough | 40/647 |
| 3,242,605 | 3/1966 | Kleinschmidt | 40/779 X |
| 4,209,212 | 6/1980 | McGoldrick . | |
| 4,255,872 | 3/1981 | Williams, Sr. | 206/232 X |
| 4,684,029 | 8/1987 | Righini | 40/607 X |
| 4,821,440 | 4/1989 | Dunn . | |
| 5,029,550 | 7/1991 | Hopper, Sr. et al. | 206/214 X |
| 5,054,862 | 10/1991 | Vanaman | 312/100 |
| 5,529,173 | 6/1996 | Salacuse | 40/779 X |
| 5,607,214 | 3/1997 | Pierce et al. | 312/230 X |
| 5,623,778 | 4/1997 | Dunn | 40/611 |
| 5,664,851 | 9/1997 | Dunn . | |
| 5,690,216 | 11/1997 | Liu | 206/214 |
| 5,894,922 | 4/1999 | Miller et al. | 206/214 |

FOREIGN PATENT DOCUMENTS

| | | | |
|---|---|---|---|
| 2270654 | 12/1975 | France . | |
| 2443846 | 4/1975 | Germany | 206/371 |
| 2403442 | 7/1975 | Germany | 206/214 |
| 3729572 | 9/1987 | Germany | 206/371 |
| 166619 | 1/1934 | Switzerland | 40/607 |
| 2224152 | 4/1990 | United Kingdom | 40/607 |

*Primary Examiner*—Peter M. Cuomo
*Assistant Examiner*—David E Allred
*Attorney, Agent, or Firm*—Terrance L. Siemens

[57] ABSTRACT

A weather resistant, ventilated case for storing and displaying messages, papers, and diverse articles in an exterior location such as a construction site. The case has a base, a cover, a hinge connecting base and cover, and a latch for securing the cover in a closed position. These components are preferably fabricated as a unitary assembly by injection molding of an elastomer. The latch can thereby be formed as resilient components urging the cover into the closed position. The cover has a transparent portion for displaying objects stored within, such as notices posted on an information display such as tack board, peg board, chalk board, marker board, or the like. The interior includes a pocket disposed upon the rear surface of the cover, a pen and pencil holder, and a prismatic recess formed in the base, for storing rolled papers. A tab projecting from the base maintains the rolled papers upright. The cover forms a recess for grasping the cover. A slot located in a protected, downwardly facing surface enables insertion of papers into the case. The rear of the case has notches disposed to cooperate with a mounting post of square cut lumber. The notches are configured to accept the mounting post in either one of two orientations each perpendicular to the other, and to present a flat rear surface for enabling the case to be flush mounted on a flat environmental surface.

14 Claims, 3 Drawing Sheets

CONSTRUCTION SITE DISPLAY AND STORAGE CASE

REFERENCE TO RELATED APPLICATION

This application is related to Ser. No. 08/554,807, filed Nov. 7, 1995, which issued as U.S. Pat. No. 5,664,851 on Sep. 9, 1997.

BACKGROUND OF THE INVENTION

1. Field of the Invention

The present invention relates to cases and cabinets for storing and displaying documents and other objects. The invention incorporates features particularly suitable for exterior mounting of the case, for providing weather protection, and for accepting insertion and storage of diverse articles in the case.

2. Description of the Prior Art

Construction sites are by their nature unfinished and ill suited to accommodate paper documents and small personal articles which may be necessary or desirable to have at hand. Temporary storage sheds may in part fill the need, but are not designed to provide dedicated storage spaces to small articles and do not accommodate display of documents such as building permits which may be required by municipal authorities to be prominently displayed on site.

The present invention improves upon prior art display cases, including the present inventor's prior U.S. Pat. Nos. 4,821,440, issued on Apr. 18, 1989, and 5,664,851, issued Sep. 9, 1997. Display of construction permits is the principal function of these device. The former describes a case having a clear or transparent hinged cover and an internal tack board for securing paper documents by tacks, staples, or other fasteners in a visible condition. The device is intended primarily for convenient, protected display of documents which are generally required to be visible and accessible to passers by. The latter describes a number of features not hitherto incorporated into display cases. Many of these features are further developed and refined in the present invention.

U.S. Pat. No. 4,209,212, issued to Darlene M. McGoldrick on Jun. 24, 1980, describes a display case having a clear or transparent door and a mounting board disposed within the base portion of the display case. The mounting board has a plurality of nails or the like from which jewelry may be suspended. These features are similar to some of those of the present invention. However, McGoldrick is silent regarding molded construction as seen in the novel display case, as well as regarding the many unique features of the novel display case.

A door for accepting insertion of letters and the like into a storage box is shown in U.S. Pat. No. 749,154, issued to George E. Benton on Jan. 12, 1904. The door is located beneath a protective hood. The present invention includes a slot formed in a soffit wall for receiving letters and the like and for protecting the interior of the novel display case from drippage. The slot and its soffit differ from the rain hood of Benton. Benton sheds no light on the many novel improvements shown in the present invention.

French Patent 2,270,654, dated Dec. 5, 1975, shows a display case having a transparent cover and a rear surface configured to cooperate with a supporting post or the like. However, the rear surface does not accommodate different orientations of the post relative to the display cabinet, as provided in the present invention.

In summary, the prior art shows some of the features of the present invention, but these features vary from corresponding features in the present invention. Furthermore, construction of a display case as a single part by injection molding, as practiced in the present invention, is not shown in the prior art.

None of the above inventions and patents, taken either singly or in combination, is seen to describe the instant invention as claimed.

SUMMARY OF THE INVENTION

The present invention improves upon prior display cases both in features and in providing a construction suitable for injection molding from an elastomeric material. Although other fabrication methods may be employed, it is desirable to form the novel display case by a method which enables both rapid manufacture and also enables most structural features of the display case to be molded integrally. The novel display case may be formed by molding two principal components, namely a base component and a cover component. An integrally molded latch resiliently holds the door or cover component closed of its own accord. Preferably, the latch is located on a side of the display case opposite that of the hinge.

In addition to the above construction, the novel display case offers features not seen heretofore in prior display cases. One feature is an information display disposed within the case. The information display may comprise a chalkboard, erasable marker board for erasably bearing recordings made from various ink depositing pens, or other erasable writing surfaces. Alternatively, the information display may hold papers and other articles in a suitable location for observation by magnetic action, by providing hooks or equivalent members for suspending articles, or by providing a plurality of holes in the manner of pegboards.

This information display operates in cooperation with a window or other provision for making the contents of the display case visible from the outside. The window may be provided by making the cover transparent or partially so. A window, if provided, may account for only a portion of the area of the cover. In such an embodiment, some of the area of the cover is devoted to advisory messages such as "no trespassing", "hard hat area", identification of a builder or supplier, and others.

Other internal features of the display case include an internal recess formed in either the base or door, with a complementing tab for holding prismatic objects such as rolled drawings in place in the recess. Either the base or the cover or both may be provided with a pen and pencil holder. The rear side of the front cover may be provided with a pocket for storing diverse articles, such as material delivery documents, personnel time cards, and others. Therefore, diverse articles may be organized and stored within the display case.

External features of the display case include ventilation holes for preventing build up of condensation, and a grasping recess in the front cover for opening the same. A mail slot is formed in the front of the cover, and is protected from drippage and minor amounts of wind driven rain by a rain hood. The cover makes sealing contact with the base of the display case. This characteristic may be achieved by forming the cover to overlap the outer dimensions of the base at the front thereof. Alternatively, the cover and base may interfit at the front of the base. The rear surface of the display case is configured to cooperate with and partially surround a post, to assist in mounting the display case on a post of stock square cut lumber. The rear surface is configured to accept the post in either of two possible orientations perpendicular to one another. This allows the display case to be mounted either longitudinally upright or longitudinally parallel relative to the ground. Mounting on a flat vertical surface is also accommodated.

Accordingly, it is one object of the invention to provide a display case which may be formed by injection molding.

It is another object of the invention to form the latch integrally with the principal components.

Still another object of the invention is to provide protection for a slot for inserting mail and the like into the display case.

An additional object of the invention is to provide a recess for grasping the cover.

It is another object of the invention to provide ventilation holes in the case for preventing build up of condensation.

Yet another object of the invention is to accommodate plural positions of the display case relative to its supporting post.

Still another object of the invention is to be able to organize articles stored within the display case.

A further object of the invention is that the cover seals the opening of the base when closed.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
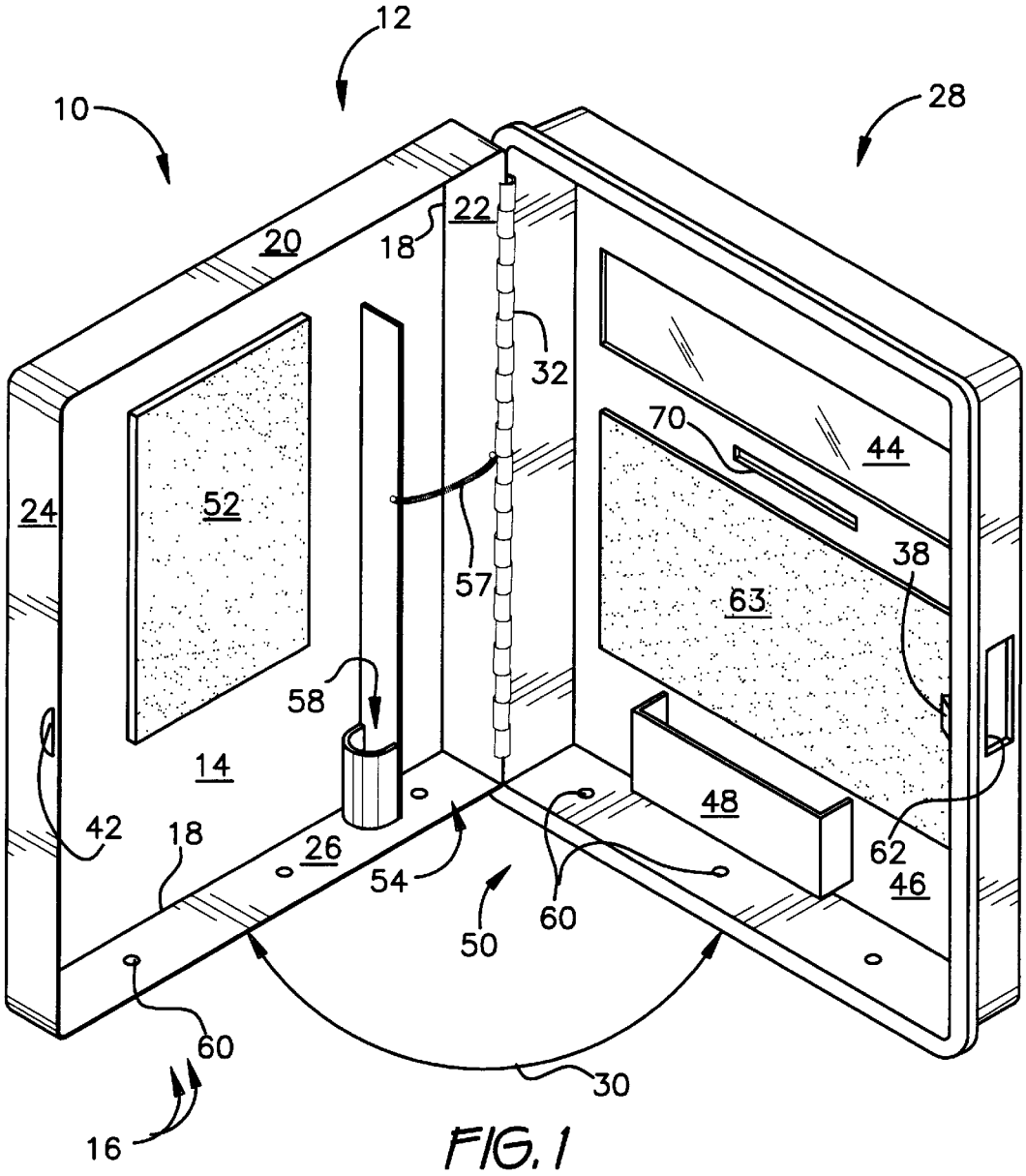
FIG. 1 is a perspective front view of the invention with the cover open, the rear surface of the cover therefore being visible and the front of the cover being concealed from view.

Turning now to FIG. 1 of the drawings, novel display and storage case 10 is shown in the open position. Case 10 comprises a base 12 having a rear wall 14 and a forwardly projecting perimetric wall 16 joined to rear wall 14 at joint 18. Preferably, case 10 is formed in the manner of a parallelepiped, so that perimetric wall 16 has a horizontal upper section 20, right and left vertical sections 22, 24, and a horizontal lower section 26. An interior is defined forwardly of rear wall 14 and within forwardly projecting perimetric wall 16.

The interior is selectively closed by a cover 28 which is pivotally attached to base 12 and is movable between a closed position (not shown) and an open position affording access to the interior of base 12. An open position is shown, it being understood that this term does not designate any particular degree of swing (indicated as arrow 30) of cover 28. In the closed position, cover 28 makes sealing contact with perimetric wall 16. This signifies that cover 28 contacts base 12 sufficiently to deny casual access to the interior to passers by. Contact may, if desired, be sufficiently tight and close so as to exclude moisture from entering the interior.

Cover 28 is pivotally connected to base 12 by a piano hinge 32. Hinge 32 enables cover 28 to be swung open to the extent indicated by arrow 30. Optionally, a torsion spring or other spring arrangement (not shown) is incorporated into case 10 to bias the cover to swing into the closed position.

Cover 28 releasably engages base 12 by a closure holding means comprising resilient latch arrangement. In the preferred embodiment, base 12, cover 28, hinge 32 and the latch arrangement are formed by injection molding of an elastomeric material. The selected material will be such that thicknesses of magnitude greater than a predetermined magnitude will form structures sufficiently rigid to resist manually applied forces. Thicknesses of magnitude less than a predetermined magnitude will form structures exhibiting limited flexibility.

These characteristics are exploited in that while base 12 and cover 28 are rigid, components of the latch are somewhat flexible. Cover 28 is secured in the closed position by the latching arrangement, which includes a projection or rigid hook 38. The latch is dimensioned and configured so that hook 38 aligns with and can releasably engage a corresponding depression 42 formed in base 12 by entering depression 42 and engaging the same by friction or interference fit. Flexibility of cover 28 is such that hook 38 resiliently withdraws from engagement with depression 42 when cover 28 is opened. Of course, respective locations of hook and depression 42 may be reversed if desired. Cover 28 is sufficiently elastic that once engaged, hook 38 will remain engaged until intentionally released.

Cover 28 is so constructed as to render objects (none shown) contained within the interior visible from outside case 10. This may be accomplished by forming cover 28 from a transparent material, by providing a transparent window (not shown) after initial fabrication of cover 28, or in any other suitable way. In the embodiment of FIG. 1, an upper zone 44 of cover 28 is transparent. A lower zone 46 is opaque. These characteristics may be imparted as part of the injection process, or may result from introducing a mask of paint, ink, or other pigmentation after fabrication of cover 28 as originally entirely transparent. Opaque zone 46 is useful for concealing a pocket 48 disposed on the rear surface 50 of cover 28 and any objects (not shown) stored in pocket 48.

Transparency of zone 44 enables notices and other data (none shown) posted on an information display 52 to be visible from the front of case 10. Display 52 may be a chalk board, erasable marking board, peg board, magnetic display board, or any other suitable surface capable of supporting papers and other imprinted media for display. Display 52 is disposed within the interior of base 12 in a position horizontally aligned with transparent zone 44 of cover 28, or in any other location visible from the front of case 10 through zone 44.

Case 10 has storage amenities dedicated and specially configured for storing specific items commonly employed on construction sites. A prismatic relief 54 is formed in base 12 and is located at a portion of perimetric wall 16, such as at right vertical section 22. A tab 57 projects from rear wall 14 proximate relief 54, so as to immobilize an object (not shown), such as a roll of blueprint drawings, which occupies relief 54, and to define bounds of relief 54. The object occupying relief 54 is immobilized in the sense of being constrained against falling from its position occupying relief 54. Preferably, the latch is located on a side of base 12 opposite that of relief 54, so that rolled papers and the like will not immediately escape when cover 28 is opened.

Another amenity available within the interior of base 12 is a holder 58 for gathering and holding writing instruments (none shown), such as pencils, pens, and ink markers. If not formed as an upwardly open well, holder 58 may comprise one or more clips (not shown) capable of closing over writing instruments.

Ventilation holes 60 are formed in base 12 and cover 28 to prevent build up of condensation over time.

Figure 2:
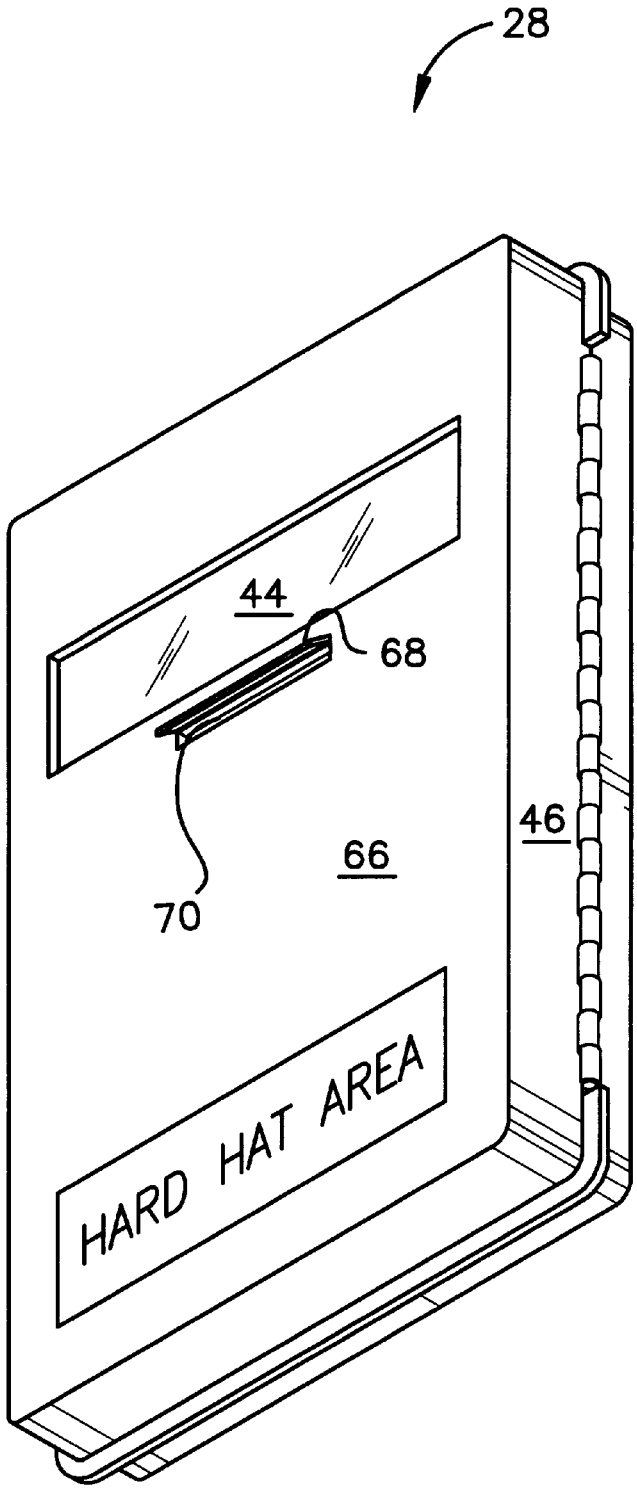
FIG. 2 is a perspective front view of the cover such that the front of the cover, which is concealed in the depiction of FIG. 1, is clearly seen in FIG. 2.

Turning now to FIG. 2, a forwardly accessible recess 62 is formed in a lateral side of cover 28. Recess 62 acts in the capacity of a handle by affording a surface by which cover 28 is grasped for opening. This arrangement minimizes complication of a handle feature and assures that the structure serving as a handle will not project beyond the front surface of cover 28, thereby minimizing bulk and volume of cover 28. Location of recess 62, acting in concert with resilience and flexibility of the constituent material of cover 28, assures that cover 28 will deform sufficiently to release hook 38 of the latch when cover 28 is grasped and pulled open. Of course, the handle feature may be provided by a projection (not shown) projecting outside cover 28, if desired. The projection need only provide a surface affording a finger hold enabling manual engagement of cover 28 for pulling cover 28 open.

A slot 70 is formed in the front surface 66 of cover 28, to accommodate insertion of objects into the interior of case 10. An extension or rain hood 68 is located above slot 70, thereby assuring that rain and contaminants will not readily enter the interior of base 12.

Figures 3, 4:
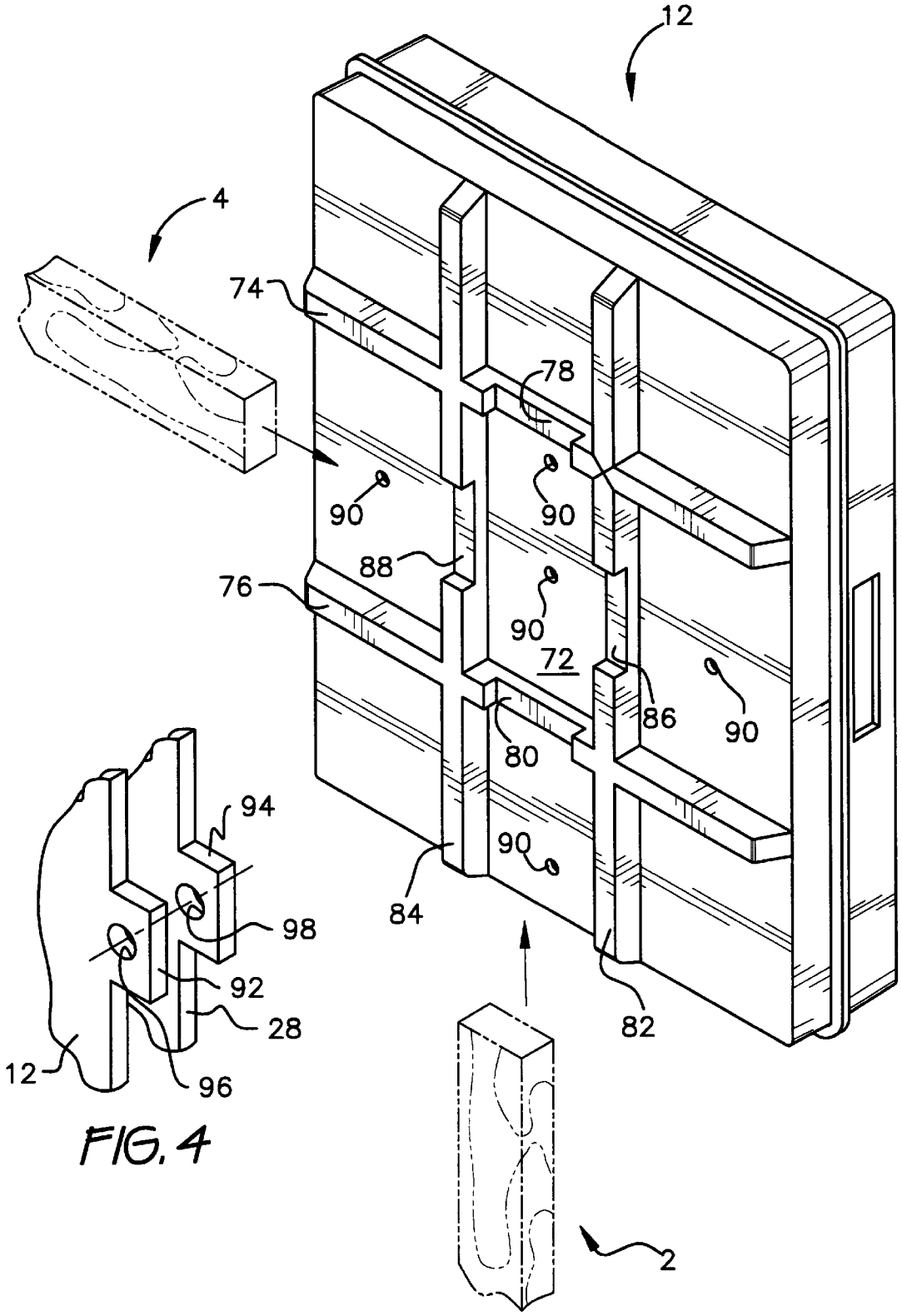
FIG. 3 is a perspective rear view of the base of the invention.
FIG. 4 is a perspective detail view of an alternative embodiment of the invention.

FIG. 3 shows rear surface 72 of base 12. Rear surface 72 bears ribs 74, 76 each having a respective notch 78 or 80. Notches 78, 80 are dimensioned and configured to cooperate with and partially surround a post (shown representatively at 2). Notches 78, 80 are disposed at a first predetermined orientation relative to base 12. Additional ribs 82, 84 are also provided, and are so oriented as to intersect ribs 74, 76. Ribs 82, 84 have notches 86, 88 which are also dimensioned and configured to cooperate with and surround a post (indicated at an alternative position as 4). The post is driven into the ground at a suitable location on the construction site. Display case 10 is mounted on the post by sliding base 12 along the post until base 12 is suitably positioned for fastening. Fasteners (not shown) such as screws may then be inserted through holes 90 and driven into the post. The user of case 10 is thus afforded a choice of orientations for mounting case 10. Since proportions of case 10 may be varied to suit, it may be mounted with the longitudinal dimension either parallel to or perpendicular to the ground. Opening of cover 28 may also be selected by mounting base 12 appropriately on the post. Ribs 74, 76, 82, 84 collectively present a flat rear surface enabling case 10 to be flush mounted on a flat surface, if desired.

FIG. 4 illustrates an alternative embodiment of the invention in which the closure holding means comprising the latching arrangement is either replaced or supplemented by an arrangement of alignable tabs 92, 94 formed respectively on base 12 and cover 28. Tabs 92, 94 meet when cover 28 is closed such that their respective holes 96, 98 align to enable the shackle of a padlock (not shown) to pass through holes 96, 98, thereby locking cover 28 in the closed position.

It is to be understood that the present invention is not limited to the embodiments described above, but encompasses any and all embodiments within the scope of the following claims.

I claim:

1. A display and storage case suitable for mounting outdoors, comprising:

a base having a rear wall and a forwardly projecting perimetric wall joined to said rear wall, there being an interior defined forwardly of said rear wall and within said forwardly projecting perimetric wall;

a cover pivotally attached to said base and movable between a closed position making sealing contact with said perimetric wall and an open position affording access to said interior of said base;

a hinge pivotally connecting said cover to said base;

a closure holding means formed integrally with one of said base and said cover and disposed to releasably engage the other of said base and said cover;

wherein said base has a rear surface having first and second pairs of ribs formed integrally on the rear surface, each pair of ribs extending perpendicular to and intersecting the other pair, said pairs of ribs both having distal flat surfaces coplanar with each other;

first notches formed in said distal flat surface of said first pair of ribs so as to form a vertical channel to cooperate with and partially surround a post adapted to be disposed at a first predetermined orientation relative to said base; and second notches formed in said distal flat surface of said second pair of ribs so as to form a horizontal channel to cooperate with and partially surround a post adapted to be disposed at a second predetermined orientation relative to said base.

2. The display and storage case according to claim 1, wherein said base, said cover, and said closure holding means are formed by injection molding from an elastomeric material.

3. The display and storage case according to claim 1, wherein said closure holding means is disposed to remain in the closed position when closed.

4. The display and storage case according to claim 1, wherein said cover has a lateral side having a recess for grasping said cover.

5. The display and storage case according to claim 4, wherein said cover deforms responsive to said recess being manipulated when opening said cover, thereby resiliently releasing said closure holding means.

6. The display and storage case according to claim 1, wherein said cover further comprises a means for rendering objects contained within said interior visible from outside said display and storage case.

7. The display and storage case according to claim 6, further comprising an information display disposed within said interior of said display and storage case in a location visible from the front of said display and storage case through said means for rendering objects visible.

8. The display and storage case according to claim 1, wherein said cover has a rear surface and a pocket disposed upon said rear surface of said cover.

9. The display and storage case according to claim 1, wherein said base has a holder for writing instruments disposed within said interior.

10. The display and storage case according to claim 1, wherein said cover has a slot formed therein, said slot opening to the interior of said cover, to accommodate insertion of objects into said interior.

11. The display and storage case according to claim 1, wherein said base has a relief formed therein and located at a portion of said forwardly projecting perimetric wall, said display and storage case further including means for immobilizing an object occupying said relief.

12. The display and storage case according to claim 1, further comprising ventilation holes formed in at least one of said base and said cover.

13. The display and storage case according to claim 1 wherein said closure holding means is provided in that said base has a first tab and said cover has a second tab, said first tab and said second tab each having a respective hole, said holes of said first tab and said second tab being alignable to permit insertion of a shackle of a padlock when said cover is in said closed position.

14. A display and storage case suitable for mounting outdoors, comprising:

a base having a rear wall and a forwardly projecting perimetric wall joined to said rear wall, there being an interior defined forwardly of said rear wall and within said forwardly projecting perimetric wall;

a cover pivotally attached to said base and movable between a closed position making sealing contact with said perimetric wall and an open position affording access to said interior of said base;

a hinge pivotally connecting said cover to said base; and a resilient latch formed integrally with one of said base and said cover and disposed to releasably engage the other of said base and said cover, wherein said base, said cover, said hinge, and said latch are formed by injection molding of an elastomeric material having resiliency, and wherein said cover has a lateral side having a recess, said cover is dimensioned and configured to include a front surface and a slot disposed in said front surface, to accommodate insertion of objects into said interior, said base has a relief formed therein and located at a portion of said forwardly projecting perimetric wall, said display and storage case further including a tab projecting from one of said base and said cover proximate said relief so as to immobilize an object occupying said relief, said cover has a rear surface and a pocket disposed upon said rear surface of said cover, said base has a holder for writing instruments disposed within said interior, said base has a rear surface with first ribs and second ribs intersecting each other thereon, said first ribs having a first distal flat surface with first notches formed therein and forming a vertical channel so as to cooperate with and partially surround a post adapted to be disposed at a first predetermined orientation relative to said base, and said second ribs having a second distal flat surface coplanar with said first distal flat surface, said second distal flat surface having second notches formed therein and forming a horizontal channel so as to cooperate with and partially surround a post adapted to be disposed at a second predetermined orientation relative to said base, said first and second ribs having a flat surface to enable said display and storage case to be flush mounted on a flat environmental surface, and said display and storage case further comprises means for rendering objects contained within said interior visible from outside said display and storage case, an information display disposed within said interior of said display and storage case in a location visible from the front of said display and storage case through said means for rendering objects visible, and ventilation holes formed in at least one of said base and said cover.

* * * * *